United States Patent [19]

Wood et al.

[11] Patent Number: 4,661,017

[45] Date of Patent: Apr. 28, 1987

[54] METHOD AND APPARATUS FOR ALIGNING UNDERWATER COMPONENTS

[75] Inventors: Norman H. Wood, Berlin, Md.; Walter E. Gray, Santa Barbara, Calif.; Charles R. Yemington; Bill G. Louis, both of Houston, Tex.

[73] Assignee: Exxon Production Research Co., Houston, Tex.

[21] Appl. No.: 718,041

[22] Filed: Mar. 29, 1985

[51] Int. Cl.[4] ..... F16L 1/04

[52] U.S. Cl. ..... 405/169; 405/191

[58] Field of Search ..... 405/169, 191; 29/237, 29/464; 417/360

[56] References Cited

U.S. PATENT DOCUMENTS

| | | | |
|---|---|---|---|
| 3,260,270 | 7/1966 | Watkins et al. | 29/464 |
| 3,298,092 | 1/1967 | Dozier et al. | 405/169 X |
| 3,722,585 | 3/1973 | Nelson et al. . | |
| 3,724,061 | 4/1973 | Schipper | 405/169 X |
| 3,880,553 | 4/1975 | Wolford et al. | 417/360 |
| 4,019,334 | 4/1977 | Sinclair et al. | 405/169 |
| 4,036,295 | 7/1977 | Kirkland et al. . | |
| 4,043,707 | 8/1977 | Heumann et al. | 417/360 |
| 4,046,192 | 9/1977 | Darnborough et al. . | |
| 4,544,036 | 10/1985 | Saliger | 405/169 X |

FOREIGN PATENT DOCUMENTS

| | | | |
|---|---|---|---|
| 31611 | 7/1981 | European Pat. Off. | 405/169 |

*Primary Examiner*—Alan Cohan
*Assistant Examiner*—John A. Rivell
*Attorney, Agent, or Firm*—Alan J. Atkinson; Richard F. Phillips

[57] ABSTRACT

A method and apparatus for aligning a component with an underwater receptacle is disclosed. The component is attached to one end of a swing arm having a hook attached to the other end. The swing arm is lowered in the water until the hook engages a pivot attached to an underwater base at a selected distance from the receptacle. Following such contact, the component is lowered in an arcuate path defined by the rotation of the swing arm about the pivot until the component is aligned with the receptacle. In another embodiment of the invention, a stop is attached to a vertical guidepost at a selected distance from the receptacle and a guidepost engaging hook pivots to lower the component into alignment with the receptacle.

4 Claims, 8 Drawing Figures

METHOD AND APPARATUS FOR ALIGNING UNDERWATER COMPONENTS

A. FIELD OF THE INVENTION

The present invention relates to a method and apparatus for remotely aligning two submerged components. More particularly, the invention relates to a swing arm which is manipulated about a pivot to align a first component with a second component.

B. BACKGROUND OF THE INVENTION

In the offshore production of oil and gas, equipment located under the water surface controls and directs the flow of oil, gas, and other production fluids from the wellbore to the water surface. Typically, the equipment is attached to a subsea base rigidly connected to the upper end of a well casing. Production tubing located within the well casing is connected to equipment such as a Christmas tree. The Christmas tree usually comprises control valves, pressure gauges, and chokes to monitor and to control the flow of the production fluids after the well has been drilled and completed. The production fluids are directed by a riser from the Christmas tree to a vessel or platform deck located at the water surface. The riser may be articulated with swivels to permit the riser to flex in response to loading forces induced by waves and ocean currents.

The valves, swivels, and other subsea components used in the production of oil and gas will eventually become worn and must be replaced. In shallow water, divers are used to perform such maintenance operations. At greater depths, the complexity and cost of manual maintenance operations increases. To simplify the replacement of undersea components at depths beyond the reach of conventional diving operations, the components of an underwater equipment package are often bundled in modular units which can be retrieved from a vessel located on the water surface. However, the concept of modular units is inefficient because single components cannot be replaced without retrieving the entire module. In addition, modular units are expensive to design and to fabricate due to the additional work necessary to ensure a proper connection between adjacent modules.

To avoid the inefficiencies associated with modular designed systems, remotely operated underwater vehicles are frequently used to replace defective underwater components and to perform other maintenance operations. Remotely operated vehicles are useful because they can be mobilized quickly and can be operated from the water surface. However, the size and weight of remotely operated vehicles limits the maneuverability of such vehicles in performing sophisticated underwater maneuvers.

Accordingly, a need exists for a method and apparatus which simplifies the alignment of undersea components. The apparatus should be easy to construct and the method should reduce the operating time necessary to align submerged components.

SUMMARY OF THE INVENTION

The present invention provides a method and apparatus for remotely aligning a first component with a second component attached to a submerged base. A pivot is connected to the base at a selected distance from the second component. A swing arm has a proximal end connected to a hook and a distal end connected to the first component. The hook is pivotably engaged with the pivot to permit the first component to be manipulated, in a generally arcuate path defined by the configuration of the swing arm and the pivotable engagement of the hook about the pivot, into alignment with the second component. In another embodiment of the invention, the swing arm is rotated about a pivotal hook in contact with a stop which is located at a selected distance from the second component.

The invention is practiced by attaching the first component to the distal end of the swing arm. The swing arm is transported until the hook is in pivotable engagement with the pivot. In a preferred embodiment, the swing arm is translationally lowered until the hook engages the pivot. The first component is then manipulated in a generally arcuate path about the pivot until the first component is aligned with the second component.

DESCRIPTION OF THE PREFERRED EMBODIMENT

Figure 1:
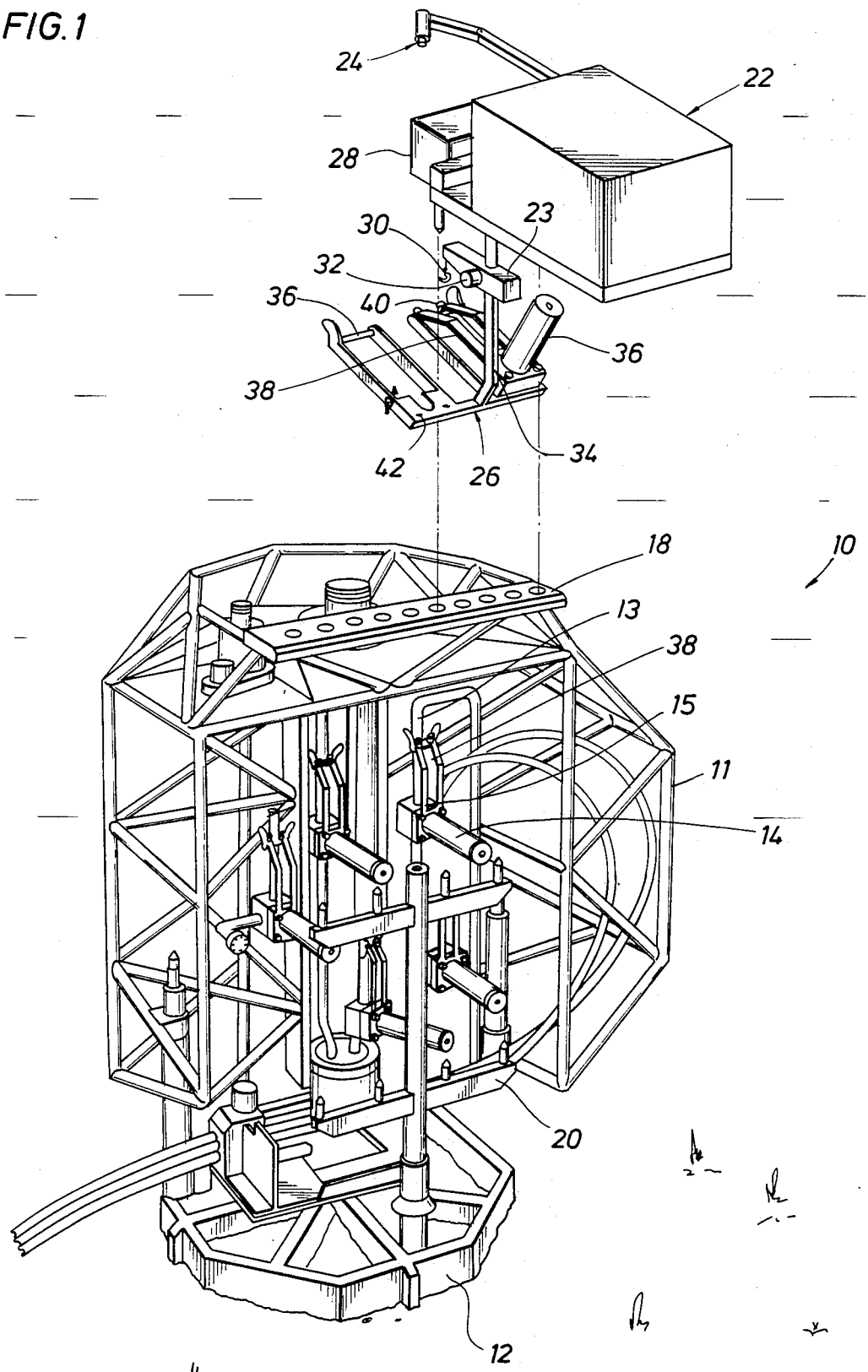
FIG. 1 is a pictorial illustration of a wet tree having a plurality of valves which are each connected to a swing arm.

FIG. 1 illustrates an underwater installation generally referred to as satellite tree 10. Guard 11, which is constructed of welded tubular pipe, protects tree 10 from damage while permitting access for wireline, workover, or maintenance operations. Wellhead base 12 is connected between tree 10 and the upper end of the well casing (not shown). Tree 10 includes conduits such as flowline 13 which are in fluid communication with production tubing (not shown) in the well casing. To regulate the flow of production fluids through flowline 13, valve 14 is connected to valve receptacle 15 in flowline 13. Other valves, valve receptacles and flowlines are illustrated in FIG. 1. Valve 14 typically may weigh 800 pounds (363 kilograms) or more in air. As illustrated, valve 14 is of the insert type so that the valve body gate, seat and operator may be entirely removed from valve receptacle 15.

It may become necessary to replace valve 14 or other underwater equipment component as the component becomes worn. Although various techniques well known in the art are used to remove a component from a subsea installation, a need exists for a method and apparatus to align a replacement component with the corresponding receptacle. The following discussion will demonstrate the application of the present invention to the replacement of a valve.

Referring to FIG. 1, tree 10 is provided with perforated docking bar 18 and guide posts 20 which are suitable for docking remotely operated vehicle 22. Vehicle 22 includes manipulator arm 23, camera 24, and tool package 26. Tool package 26 includes ballast 28, cable 30, hydraulically powered winch assembly 32, and valve handling package 34. Replacement valve 36 is connected to the distal end of swing arm 38 and is carried by valve handling package 34. Hook 40 is connected to the other, proximal end of swing arm 38. Valve handling package 34 includes apertures 42 for bolting valves to valve handling package 34.

Figure 2:
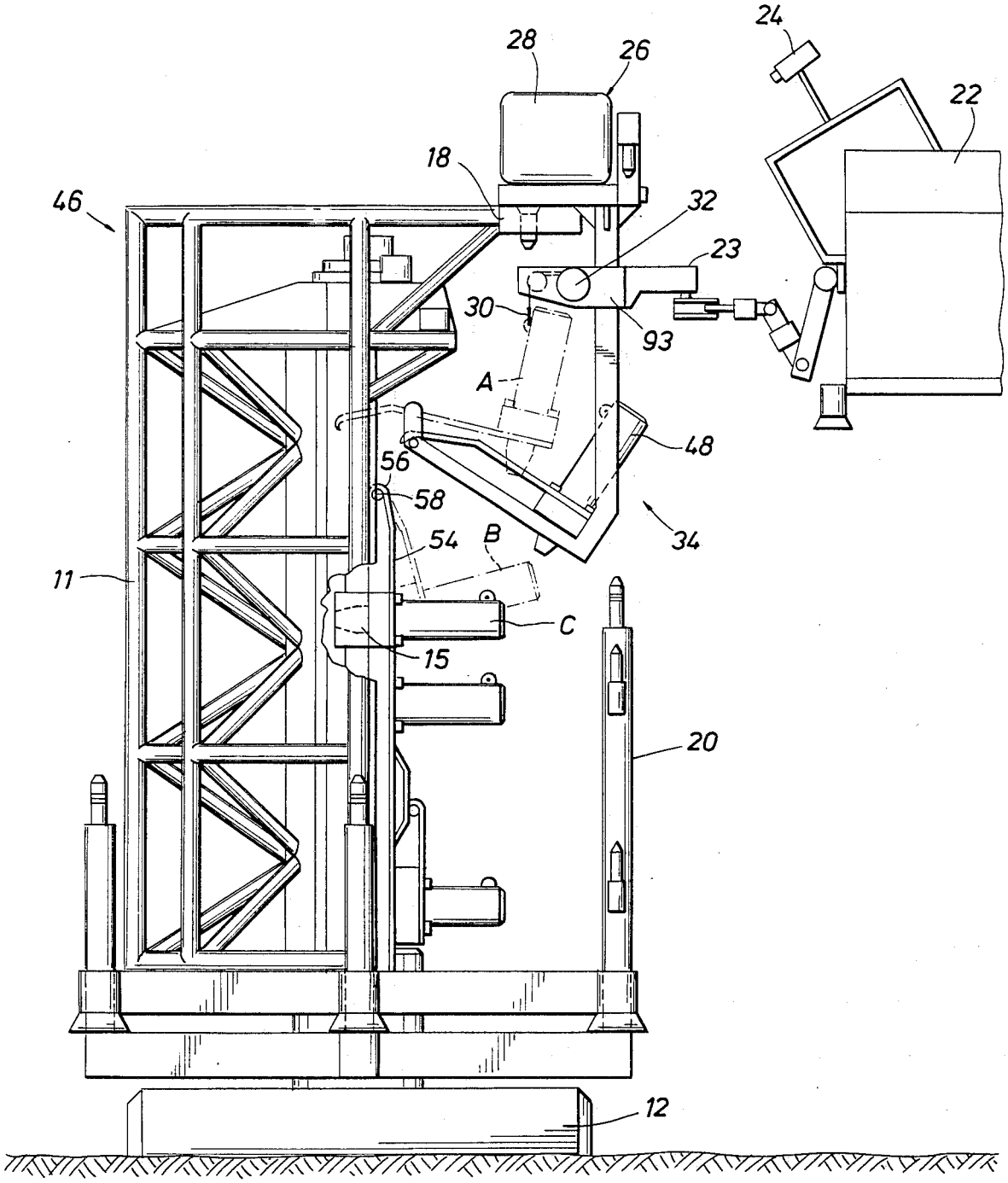
FIG. 2 is an elevation view of a simplified wet tree which shows in phantom the consecutive positions of a replacement valve as the valve is aligned with a valve receptacle.

FIG. 2 is a side, elevation view of wet tree 46. Tool package 26 is docked to tree 46 by vehicle 22. Vehicle 22 may thereafter disengage from tool package 26 and may dock on guide posts 20 to remove defective valve 48 (previously in position C) from tree 46 using conventional techniques. After defective valve 48 has been removed from tree 46, cable 30 is connected to padeye 52 on replacement valve 50. Valve 50 is then removed from valve handling package 34 and is raised into position A. Valve 50 and attached swing arm 54 are then lowered until hook 56 pivotably engages pivot 58. Padeye 52 may be positioned so that when valve 50 and swing arm 54 are supported by cable 30, swing arm 54 assumes a substantially horizontal position (see position A). Swing arm 54 may then be translationally lowered until hook 56 engages pivot 58.

Figure 3:
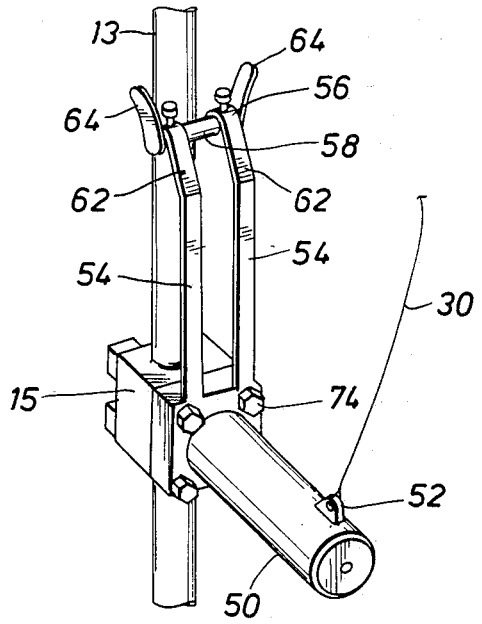
FIG. 3 is an enlarged pictorial illustration of a valve attached to a slotted swing arm.

Referring now to FIG. 3, swing arm 54, horizontal pivot 58, and valve 50 are shown in greater detail. Pivot 58 is connected to vertical flowline 13 at a selected distance from valve receptacle 15. The distance between pivot 58 and valve receptacle 15 will therefore determine the effective length of swing arm 54. Swing arm 54 is illustrated as being slotted to form two substantially parallel elongated members or legs 60 which are equal in length. Hooks 56 are connected to legs 60 for pivotable engagement with pivot 58. Swing arm 54 may be welded to valve 50 or attached by other conventional means.

Cable 30 supports the weight of swing arm 54 and valve 50 as valve 50 is lowered in place by hydraulic winch assembly 32. The length and orientation of swing arm 54 will determine the ease with which swing arm 54 engages pivot 58. Although a longer swing arm 54 permits more error in engaging pivot 58, a longer swing arm will require a taller tree and more vertical distance between valves. As illustrated in FIG. 3, swing arm 54 may include dogleg or offset sections 62. Although swing arm 54 is rigidly constructed, offset portions 62 enable the distance between the proximal and distal ends of swing arm 54 to vary slightly during the installation of valve 50.

To install valve 50 in valve receptacle 15, swing arm 54 is manipulated until legs 60 straddle flowline 13. Swing arm 54 is then lowered along flowline 13 until hooks 56 pivotably engage pivot 58. Projecting ears 64 attached to each end of pivot 58 prevent vehicle 22 from inadvertently jarring hooks 56 from engagement with pivot 58. Cable 30 is paid out to permit swing arm 54 to rotate about pivot 58 until valve 50 is brought into the final alignment position with receptacle 15.

Figure 4:
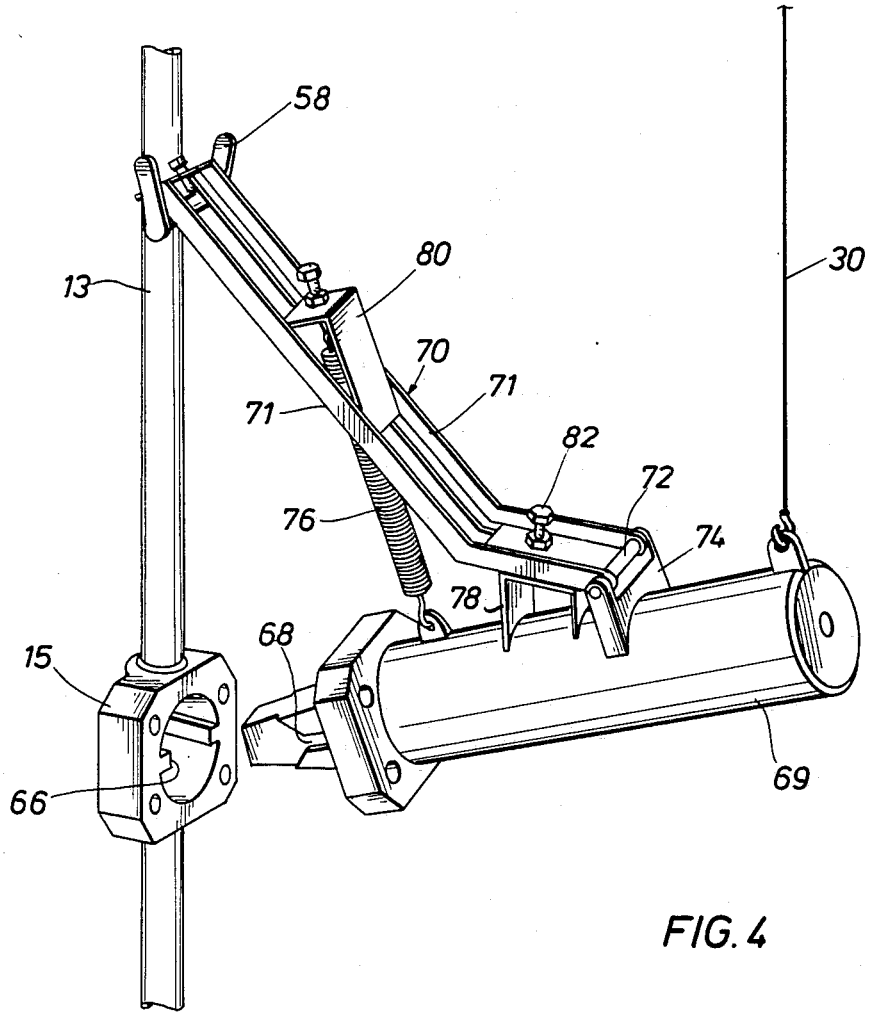
FIGS. 4 and 5 each depict alternate embodiments of a swing arm and replacement valve shown.

Referring to FIG. 4, an alternate embodiment of the present invention is shown. Valve receptacle 65 is illustrated as having a pair of keys 66 which guide keyways 68 located in the engagement end of valve 69 during final alignment of valve 69 with valve receptacle 65. As cable 30 is paid out to transport valve 69 into engagement with receptacle 65, keyways 68 guide the engagement end of valve 69 into final alignment. According to the present invention, valve 69 moves in a generally arcuate path about pivot 58. Although swing arm 70 is preferably designed so that valve 69 moves substantially horizontally when being brought into alignment with valve receptacle 65, it is apparent that the movement of valve 69 during final alignment is not truly horizontal. Accordingly, keyways 68 may be modified, as shown in FIG. 4, so that the length of keyways 68 do not extend to the engagement end of valve 69. The swing arm of the present invention obtains rough and medium alignment of valve 69 with receptacle 65 and therefore minimizes the possibility of damage to control line disconnects in valve 69.

After swing arm 70 achieves rough and medium alignment of valve 69, final alignment and installation may be obtained by making up disconnects, aligning wedges, and tightening installation bolts according to conventional practices.

Swing arm 70 shown in FIG. 4 is constructed with swing arm members or legs 71 which are pivotably connected at pin 72 to stub 74. Stub 74 is firmly connected to valve 69. The angular position of valve 69 relative to legs 71 may be controlled through the combination of spring 76 and bumper 78. Spring 76 is connected at one end to valve 69 and at the other end to bracket 80. Bracket 80 is slidably engaged with legs 70. If the engaging end of valve 69 pivots away from swing arm 70, the resultant force exerted by spring 76 returns valve 69 to its normal position. Bumper 78 is adapted for engagement with swing arm 70 and with valve 69 to limit pivotal movement of valve 69 toward swing arm 70. Spring 76 permits slight movement of valve 69 relative to swing arm 70 to facilitate final alignment of valve 69 with receptacle 65. Adjustment screw 82 may be attached to swing arm 70 to control the final alignment of valve 69.

Prior to final alignment of valve 69 with receptacle 65, spring 76 normally holds valve 69 against bumper 78. As the engagement end of valve 69 approaches receptacle 65, cable 30 can be raised slightly to lower the engagement end of valve 69. To raise the engagement end of valve 69 so that valve 69 is properly aligned with receptacle 65, cable 30 may be slightly lowered to permit spring 76 to raise the engagement end of valve 69 relative to valve receptacle 65.

The swing arm shown in FIG. 3 is generally suitable in applications where a valve is to be aligned with a valve receptacle, provided that the structural dimensions of the swing arm and the position of the pivot relative to the valve receptacle are properly maintained within tolerances conventional for welded structural components. If substantial deviation from these tolerances is anticipated, it may be preferable to use a swing hook having the alignment capabilities illustrated in FIG. 4.

Referring to FIG. 2, a typical valve replacement operation will be described. Initially, vehicle 22 will dock tool package 26 to tree 46 according to conventional practice. Vehicle 22 will release itself from tool package 26 and will dock on guide post 20. Hydraulic winch assembly 32 is activated to lower the end of cable 30. Manipulator arm 23 of vehicle 22 connects cable 30 to defective valve 48, and defective valve 48 is disconnected from receptacle 15 by using a standard socket wrench (not shown). Defective valve 48 is raised by winch 32 to a position above valve handling package 34.

Vehicle 22 undocks from guide post 20, and manipulator arm 23 maneuvers davit 96 so that defective valve 48 is directly over the vacant side of valve handling package 34. After defective valve 48 has been lowered and connected to valve handling package 34, manipulator arm 23 may again be used to maneuver davit 96 until replacement valve 50 is below cable 30. Replacement valve 50 is then detached from valve handling package 34 and is raised by winch assembly 32 to position A. As previously set forth, padeye 52 on valve 50 is preferably positioned so that swing arm 54 assumes a substantially horizontally position when valve 50 and swing arm 38 are supported by cable 30.

Valve 50 is subsequently lowered by winch assembly 32, with legs 71 guided by flowline 13, until swing arm 54 engages pivot 58. Subsequent lowering of valve 50 will cause swing arm 54 to rotate about pivot 58 and to lower valve 50 in a generally arcuate path. This position is generally shown as position B. Additional lowering of valve 50 will automatically align the engagement end of valve 50 with valve receptacle 15. Thereafter, valve 50 may be secured to receptacle 15 by techniques well-known in the art.

Following the installation of valve 50, vehicle 22 and tool package 26 may undock from the tree or may be moved into position for the next task. Swing arm 54 may also be used to remove the defective valve from tree 46, even though removal does not present alignment problems between the valve and the valve receptacle. However, removal of the valve is advantageous because the swing arm controls the position of the defective valve as the valve is disconnected from the receptacle. Therefore the defective valve will be unlikely to damage the valve receptacle upon removal.

Because of the difficulty in aligning components in a subsea environment using a remotely operated vehicle, winch 32 may be located in a different vertical plane than flowline 13 when swing arm 54 and hooks 56 are lowered into engagement with pivot 58. A significant advantage of the present invention is that swing arm 54 will automatically align valve 50 with receptacle 15 even if winch assembly 32 is not directly over receptacle 15.

Figure 5:
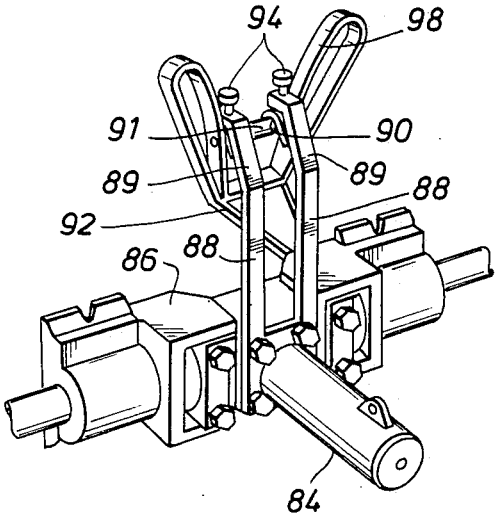

FIG. 5 depicts an alternate embodiment of the present invention adapted to dual flange valve 84 and pipeline connector 86. Valve 84 provides the necessary connection between flow lines on a wet tree. In order to assist in the replacement of valve 84 by vehicle 22, swing arm legs 88 having offsets 89 are illustrated. Pivot 91 is attached to bracket 92 which is structurally connected to pipeline connector 86.

FIG. 5 also illustrates adjustment screws 94 between the pivot 91 and swing arm legs 88. The position of swing arm legs 88 relative to pivot 91 can thus be adjusted, although hooks 90 remain in pivotal engagement with pivot 91. If the engagement end of valve 84 is not in its proper position with respect to pipeline connector 86 as valve 84 is lowered in place by swing arm 87, vehicle 22 can adjust screws 94 to vary the position of the engagement end of valve 84 relative to pipeline connector 86.

Figure 6:
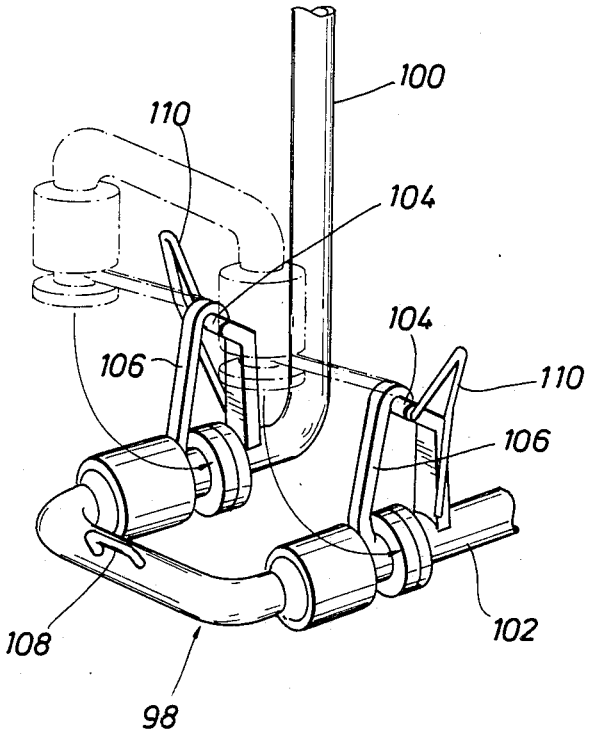
FIG. 6 illustrates the application of the present invention to the installation of a subsea swivel loop.

FIG. 6 depicts a simplified pictorial view of swivel loop 98 which is a standard component of a marine production riser. During replacement, swivel loop 98 may be aligned with piping runs 100 and 102 in a manner similar to the alignment of a valve with a receptacle. Pivots 104 are connected to piping runs 100 and 102. Swivel loop 98 and attached swing arms 106 are shown in phantom lines for their approximate positions when swing arms 106 might first engage the pivots 104. Handle 108 on swivel loop 98 is provided for engagement with a hook at the end of a cable (not shown), and swing arms 106 may be connected to each side of swivel loop 98. Guide brackets 110 project outwardly to guide swing arms 106 toward pivots 104 and to retain swing arms 106 on pivots 104 as swivel loop 98 is lowered into engagement with piping runs 100 and 102.

Figure 7:
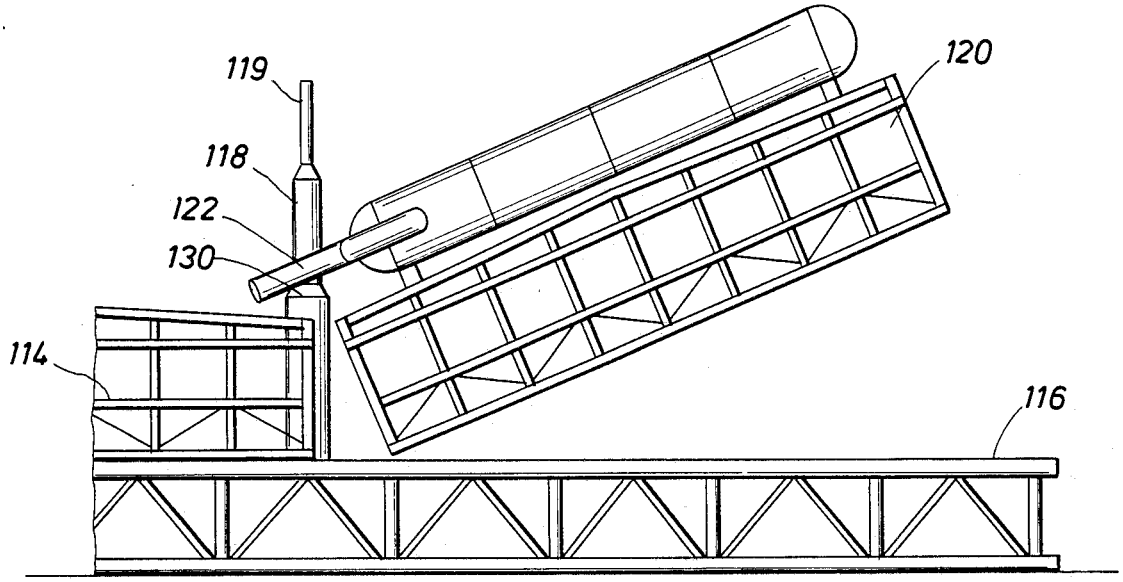
FIG. 7 illustrates the installation of a subsea manifold section by using a modified swing arm which rotates about a pivotal hook.

FIG. 7 shows an alternative embodiment of the present invention applied to the replacement of an underwater manifold section. Referring to FIG. 7, manifold section 114 is attached to a subsea base such as frame 116. Guidepost 118 is also connected to frame 116 so that the longitudinal axis of guidepost 118 is substantially vertical. Each guidepost 118 has an alignment post 119 having a smaller diameter than the diameter of guideposts 118. Replacement manifold section 120, which is adapted to engage section 114, is also shown. Hook 122, which is connected to section 120, is adapted to slidably engage guidepost 118.

Figure 8:
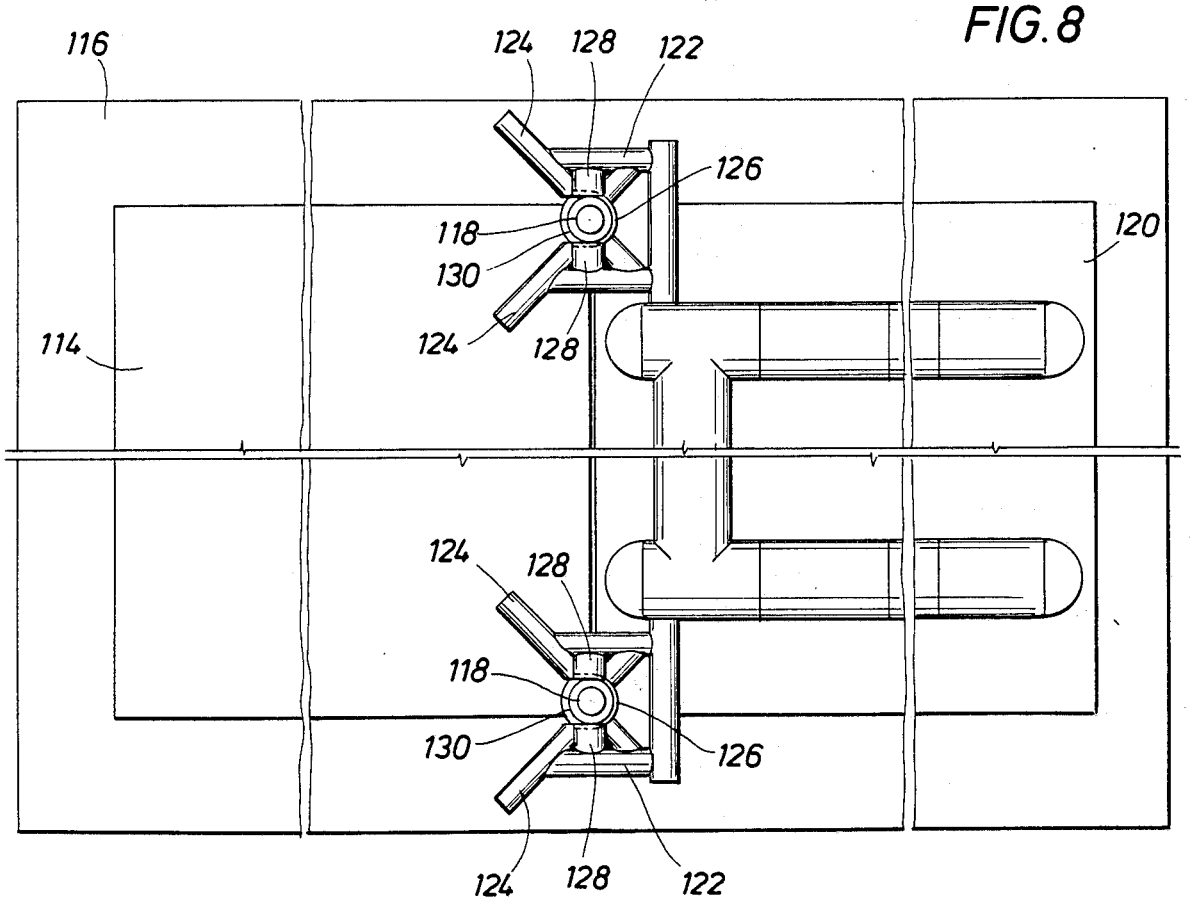
FIG. 8 illustrates a plan view of the embodiment shown in FIG. 7.

FIG. 8 shows two hooks 122 connected to section 120 which are slidably engaged with guideposts 118. Each hook 122 includes a guide fork 124 which directs guidepost 118 into a portion of hook 122 which is shown as sleeve 126. Sleeve 126 is illustrated as a cylinder which is partially sectioned to permit engagement with guidepost 118. As shown in FIG. 8, sleeve 126 is connected to pivots 128 which permit rotation of sleeve 126 relative to guide forks 124 of hook 122. The length of the effective swing arm shown in FIG. 7 can be determined by measuring the length of a line which intersects the axis of pivots 128 and which is normal to a longitudinal axis through section 120.

Manifold section 120 is installed by lowering section 120 in the water until guide forks 124 reach an elevation corresponding to the elevation of alignment posts 119. Section 120 is then transported horizontally until sleeves 126 of guide forks 124 are in engegament with alignment posts 119. Section 120 is then lowered, as permitted by the sliding engagement of sleeves 126 along alignment posts 119, until sleeves 126 are in sliding engagement with guideposts 118. Section 120 is then lowered until the lower end of sleeves 126 engage stops 130 which are attached to guideposts 118 at a selected distance from manifold section 114. At such moment, the downward translation of section 120 is prevented by the contact between sleeves 126 and stops 130, and section 120 begins to rotate about pivots 128 as shown in FIG. 7. Section 120 rotates, in a fashion similar to that previously described for other embodiments of the invention, until section 120 engages section 114.

The foregoing description for the installation of manifold section 120 illustrates the versatility of the present invention in aligning underwater components. The invention permits the simultaneous alignment of a number of pipes in a manifold section by restricting the movement of the manifold section to simple rotation about a fixed pivot. Although the pivots may be connected to a guidepost or other portion of an underwater base, the pivots can also be attached to the hooks or to a portion of the swing arm.

Although the pivot could be installed during the fabrication of a subsea installation, the pivot could also be subsequently attached to an existing subsea assembly. Alternatively, substantially horizontal flow lines or tubular members of a welded truss frame (as is shown in FIG. 1) could be used to function as the pivot. Although the FIGS. 1–8 illustrate swing arms having a substantially horizontal axis relative to the sea floor as the swing arms engage the pivots, the pivots could be located with a substantially vertical axis or at some other angle relative to the sea floor. In such an embodiment, the swing arms could be manipulated by a force other than gravity to rotate the components into alignment with each respective receptacle.

The present invention discloses a unique method and apparatus for remotely aligning underwater components such as valves, control pods, control line seals, and other components with the respective receptacles, flanges, mounting brackets, or installation fixtures. The invention is particularly useful in the remote alignment of underwater components. Although the present invention may be operated from an underwater vehicle, the invention may also be practice from a manned bell, atmospheric diving suit, or other underwater repair system.

It should be apparent from the foregoing that many other variations and modifications of the methods and apparatus described herein may be made without departing from the scope of the present invention. Accordingly, it should be understood that the forms of the invention described herein are illustrative only and that other embodiments will properly fall within the scope of the invention.

What is claimed is:

1. An apparatus for remotely aligning a first component with a second component attached to a submerged base, comprising:

a substantially horizontal pivot member secured in fixed relation to said second component at a position above said second component;

a swing arm having opposed first and second ends, said first component being secured to said first end of said swing arm;

a hook secured to said swing arm second end, said hook being adapted for pivotal engagement with said pivot member, said swing arm and first component being configured such that they may be lowered from above said pivot member to cause said swing arm to contact said pivot member intermediate said first and second ends of said swing arm, whereupon further lowering causes said hook to pivotably engage said pivot member and said first component to thereafter move in an arcuate path into alignment with said second component as said swing arm and first component are further lowered; and means secured to said swing arm for adjusting the orientation of said first component relative to said swing arm.

2. The remote alignment apparatus as set forth in claim 1 wherein said pivot member includes an elongated cylinder having a horizontal central axis.

3. The remote alignment apparatus as set forth in claim 2 comprising two hooks secured to said swing arm second end.

4. The remote alignment apparatus as set forth in claim 3 wherein said swing arm is comprised of two elongate members, each of said members having one of said hooks secured thereto, said elongate members being laterally spaced one from the other to define an intermediate space extending between the first and second ends of said swing arm.

* * * * *